US007182125B2

(12) United States Patent
Martin et al.

(10) Patent No.: US 7,182,125 B2
(45) Date of Patent: Feb. 27, 2007

(54) LOW PROFILE HEAT EXCHANGER WITH NOTCHED TURBULIZER

(75) Inventors: Michael Martin, Oakville (CA); Alan Wu, Kitchener (CA); Tim Miller, Burlington (CA)

(73) Assignee: Dana Canada Corporation, Oakville (CA)

( * ) Notice: Subject to any disclaimer, the term of this patent is extended or adjusted under 35 U.S.C. 154(b) by 296 days.

(21) Appl. No.: 10/724,481

(22) Filed: Nov. 28, 2003

(65) Prior Publication Data

US 2005/0115701 A1 Jun. 2, 2005

(51) Int. Cl.
*F28F 13/12* (2006.01)

(52) U.S. Cl. ..... 165/109.1; 165/80.4; 165/170

(58) Field of Classification Search ..... 165/80.4, 165/109.1, 170
See application file for complete search history.

(56) References Cited

U.S. PATENT DOCUMENTS

| | | | | |
|---|---|---|---|---|
| 1,049,695 | A | 1/1913 | Garrison | |
| 1,318,875 | A | 10/1919 | Hutchinson | |
| 1,775,819 | A | 9/1930 | Fischer et al. | |
| 1,996,622 | A | 4/1935 | Lambert | |
| 2,039,593 | A | 5/1936 | Hubbuch et al. | |
| 2,154,216 | A | 4/1939 | Savage | |
| 2,360,123 | A * | 10/1944 | Gerstung et al. | 165/298 |
| 2,547,668 | A | 4/1951 | Simelaar | |
| 2,582,358 | A | 1/1952 | Schoellerman | |
| 2,796,239 | A | 6/1957 | Holmes et al. | |
| 2,814,470 | A | 11/1957 | Peterson | |
| 2,981,520 | A | 4/1961 | Chadburn | |
| 2,985,434 | A | 5/1961 | Bering et al. | |
| 3,024,003 | A | 3/1962 | Speca et al. | |
| 3,141,500 | A | 7/1964 | Raskin | |
| 3,147,800 | A | 9/1964 | Tadewald | |
| 3,229,764 | A * | 1/1966 | Ware | 165/167 |
| 3,650,310 | A | 3/1972 | Childress | |
| 3,800,868 | A | 4/1974 | Berkowitz | |
| 3,818,984 | A | 6/1974 | Nakamura et al. | |
| 4,002,200 | A | 1/1977 | Raskin | |

(Continued)

FOREIGN PATENT DOCUMENTS

| | | |
|---|---|---|
| CH | 220299 | 3/1942 |

(Continued)

OTHER PUBLICATIONS

Fuel Cooling Needs for Advanced Diesel Engines by Michael Davies, John Burgers and Nick Kalman in SAE Technical Paper Series, May 19-22, 1997.

*Primary Examiner*—Allen J. Flanigan
(74) *Attorney, Agent, or Firm*—Ridout & Maybee LLP

(57) ABSTRACT

A multi-pass heat exchanger including first and second plates forming a fluid chamber therebetween having an inlet opening and an outlet opening, and a turbulizer plate having rows of fluid flow augmenting convolutions in the fluid chamber, the turbulizer plate including at least one barrier dividing the fluid chamber into first and second pass regions such that fluid flowing in the fluid chamber flows around an end of the barrier when flowing from the first pass region to the second pass regions, the turbulizer plate having portions defining a notch area therebetween for fluid to pass through when flowing in the fluid chamber around the end of the barrier from the first pass region to the second pass region.

20 Claims, 7 Drawing Sheets

U.S. PATENT DOCUMENTS 4,072,188 A 2/1978 Wilson
4,085,728 A 4/1978 Tomchak
4,134,195 A 1/1979 Jacobsen et al.
4,361,184 A 11/1982 Bengtsson
4,478,277 A 10/1984 Friedman et al.
4,574,876 A 3/1986 Aid
4,615,129 A 10/1986 Jackson
4,623,019 A * 11/1986 Wiard ..... 165/146
4,646,815 A 3/1987 Iwata
4,872,578 A * 10/1989 Fuerschbach et al. ..... 165/167
5,009,557 A 4/1991 Dessirier
5,028,989 A 7/1991 Naganuma et al.
5,099,311 A 3/1992 Bonde et al.
5,129,473 A 7/1992 Boyer
5,152,255 A 10/1992 Fukuda
5,159,529 A 10/1992 Lovgren et al.
5,174,258 A 12/1992 Tanaka
5,205,348 A 4/1993 Tousignant et al.
5,228,511 A 7/1993 Boquel et al.
5,232,066 A 8/1993 Schnelker
5,251,718 A 10/1993 Inagawa
5,273,386 A 12/1993 Luhm
5,285,347 A 2/1994 Fox et al.
5,316,077 A 5/1994 Reichard
5,381,510 A 1/1995 Ford et al.
5,423,376 A 6/1995 Julien et al.
5,490,559 A 2/1996 Dinulescu
5,495,889 A 3/1996 Dubelloy
5,517,757 A 5/1996 Hayashi et al.
5,586,614 A 12/1996 Kouchi et al.
5,787,613 A 8/1998 Derome
5,829,517 A 11/1998 Schmid et al.
5,901,037 A 5/1999 Hamilton et al.
5,918,664 A 7/1999 Torigoe
5,934,364 A 8/1999 Chrysler et al.
5,957,230 A 9/1999 Harano et al.
5,979,542 A 11/1999 Inoue
5,984,000 A 11/1999 Nakamura et al.
5,992,552 A 11/1999 Eto
6,039,112 A * 3/2000 Ruppel et al. ..... 165/109.1
6,098,706 A 8/2000 Urch
6,109,217 A 8/2000 Hedlund
6,199,626 B1 * 3/2001 Wu et al. ..... 165/167
6,227,290 B1 5/2001 Nishishita et al.
6,241,011 B1 6/2001 Nakamura et al.
6,244,334 B1 * 6/2001 Wu et al. ..... 165/166
6,293,338 B1 9/2001 Chapman et al.
6,305,463 B1 10/2001 Salmonson
6,340,053 B1 * 1/2002 Wu et al. ..... 165/167
6,438,840 B2 8/2002 Tavi et al.
6,536,516 B2 3/2003 Davies
6,729,389 B2 5/2004 Ohashi
6,843,311 B2 * 1/2005 Evans et al. ..... 165/167
6,843,512 B2 1/2005 Fritze et al.
7,025,127 B2 * 4/2006 Wu et al. ..... 165/170
2002/0079095 A1 * 6/2002 Davies et al. ..... 165/170
2003/0164233 A1 * 9/2003 Wu et al. ..... 165/166
2003/0173068 A1 9/2003 Davies et al.
2004/0069474 A1 4/2004 Wu et al.
2004/0238162 A1 12/2004 Seiler et al.
2005/0011635 A1 * 1/2005 Liu et al. ..... 165/109.1
2005/0115700 A1 6/2005 Martin et al.

FOREIGN PATENT DOCUMENTS

DE 0S 2 201 559 7/1973
DE 33 28 229 10/1985
DE 297 15 878 U1 9/1997
DE 297 22 841 U1 12/1997
DE 298 03 166 5/1998
DE 202 07 168 U1 5/2002
EP 0805328 11/1997
EP 0807756 11/1997
EP 0826874 3/1998
EP 0890810 1/1999
EP 0907061 4/1999
FR 1189606 10/1959
FR 1534246 7/1968
FR 2748800 11/1997
FR 2769082 4/1999
FR 2772838 6/1999
FR 2774462 8/1999
FR 2774463 8/1999
FR 2774635 8/1999
FR 2778973 11/1999
FR 2785377 5/2000
GB 259824 10/1926
GB 766331 1/1957
GB 2277781 11/1994
JP 61-66061 4/1986
JP 7-280484 10/1995
WO WO 94/23257 10/1994
WO WO 94/23449 10/1994
WO WO 01/25711 4/2001
WO WO 03/059598 7/2003
WO WO 03/71213 8/2003

* cited by examiner

LOW PROFILE HEAT EXCHANGER WITH NOTCHED TURBULIZER

BACKGROUND OF THE INVENTION

The present invention relates to heat exchangers used for cooling fluid.

Low profile heat exchangers are typically used in applications where the height clearance for a heat exchanger is quite low, for example, slush box coolers in snow mobiles, and under-body mounted fuel coolers in automotive applications. One style of known low profile heat exchangers include a louvered plate that is exposed to air flow, snow and general debris, with a serpentine tube affixed to and passing back and forth across the plate. The fluid to be cooled passes through the serpentine tube. Another style of known low profile heat exchanger includes fins running transverse to and integrally extruded with top and base walls that are connected along opposite side edges to define a cavity that is welded shut at opposite ends after extrusion to provide a fluid cooling container.

Known low profile heat exchangers can be heavy and can be relatively expensive to manufacture. Thus, there is a need for a low profile heat exchanger that is relatively lightweight, durable, and relatively cost efficient to manufacture. Also desired is a low profile heat exchanger that has an improved heat transfer and/or pressure drop for its relative size.

SUMMARY OF THE INVENTION

According to one embodiment of the present disclosure, a heat exchanger comprises a first plate and a second plate joined about a periphery thereof to the first plate, the first plate and second plate having substantially planar spaced apart central portions defining a fluid flow chamber therebetween having an inlet opening, an outlet opening and spaced apart first and second ends. A flow circuiting barrier in the flow chamber extends from substantially the first end of the fluid flow chamber to a barrier termination location that is spaced apart from the second end of the fluid flow chamber, the barrier dividing the fluid chamber into first and second flow regions in flow communication with each other between the barrier termination location and the second end of the fluid flow chamber. A turbulizer having rows of fluid flow augmenting convolutions is located in the first and second flow regions and includes portions defining a notch area therebetween, at least part of the notch area being between the barrier termination location and the second end. The notch area provides a turbulizer free area in the fluid chamber between the barrier termination location and the second end.

According to another example of the invention is a heat exchanger that includes a first plate and a second plate joined about a periphery thereof to the first plate, the first plate and second plate having substantially planar spaced apart central portions defining a fluid flow chamber therebetween having a first end and a second end and an inlet opening and an outlet opening. There is a turbulizer plate located in the flow chamber and having rows of fluid flow augmenting convolutions, the turbulizer plate extending from substantially the first end to the second end of the flow chamber and having a plurality of the convolutions crimped for forming a flow circuiting barrier extending from the first end to a barrier end spaced apart from the second end for dividing the flow chamber into adjacent flow regions that are in flow communication between the barrier end and the second end. The turbulizer plate defines a notch area that decreases in area inward from the second end for providing a turbulizer plate free area in the fluid chamber between the barrier end and the second end.

According to still another example of the invention is a multi-pass heat exchanger including first and second plates forming a fluid chamber therebetween having an inlet opening and an outlet opening, and a turbulizer plate having rows of fluid flow augmenting convolutions in the fluid chamber, the turbulizer plate including at least one barrier dividing the fluid chamber into first and second pass regions such that fluid flowing in the fluid chamber flows around an end of the barrier when flowing from the first pass region to the second pass region, the turbulizer plate having portions defining a notch area therebetween for fluid to pass through when flowing in the fluid chamber around the end of the barrier from the first pass region to the second pass region. The notch area provides a turbulizer free area in the fluid chamber between the end of the barrier and an end of the fluid chamber.

BRIEF DESCRIPTION OF THE DRAWINGS

Example embodiments of the present invention will be described, by way of example with reference to the following drawings.

DESCRIPTION OF THE PREFERRED EMBODIMENTS

Figure 1:
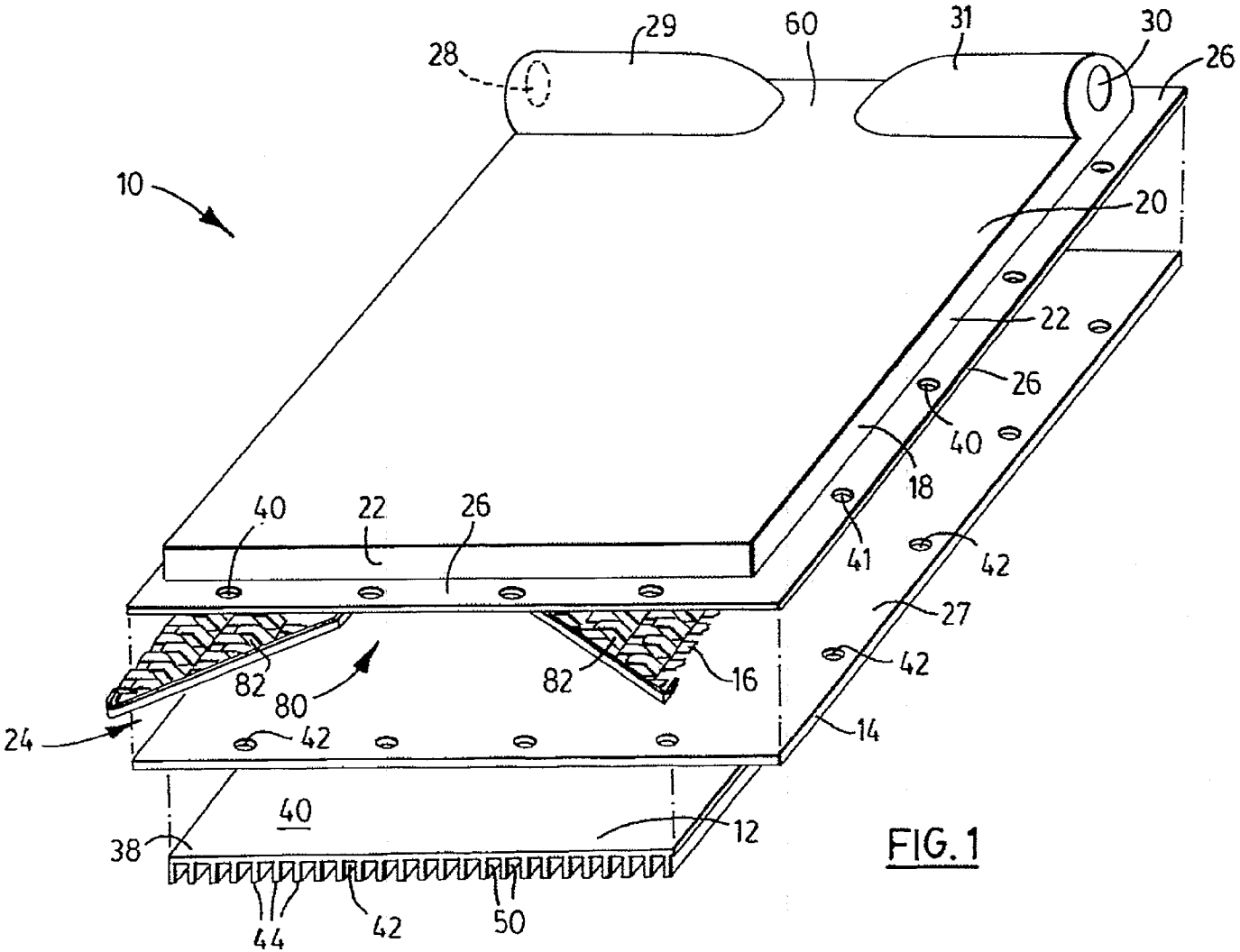
FIG. 1 is an exploded perspective view of a heat exchanger according to an example embodiment of the invention.

With reference to FIG. 1, there is shown an exploded view of a heat exchanger, indicated generally by reference numeral 10, according to an example embodiment of the invention. The heat exchanger 10 includes a base plate 14, a turbulizer plate 16, and a cover plate 18. In various embodiments, the heat exchanger 10 may also include a fin plate 12. The plates are shown vertically arranged in FIG. 1, but this is for the purposes of explanation only. The heat exchanger can have any orientation desired.

Figure 2:
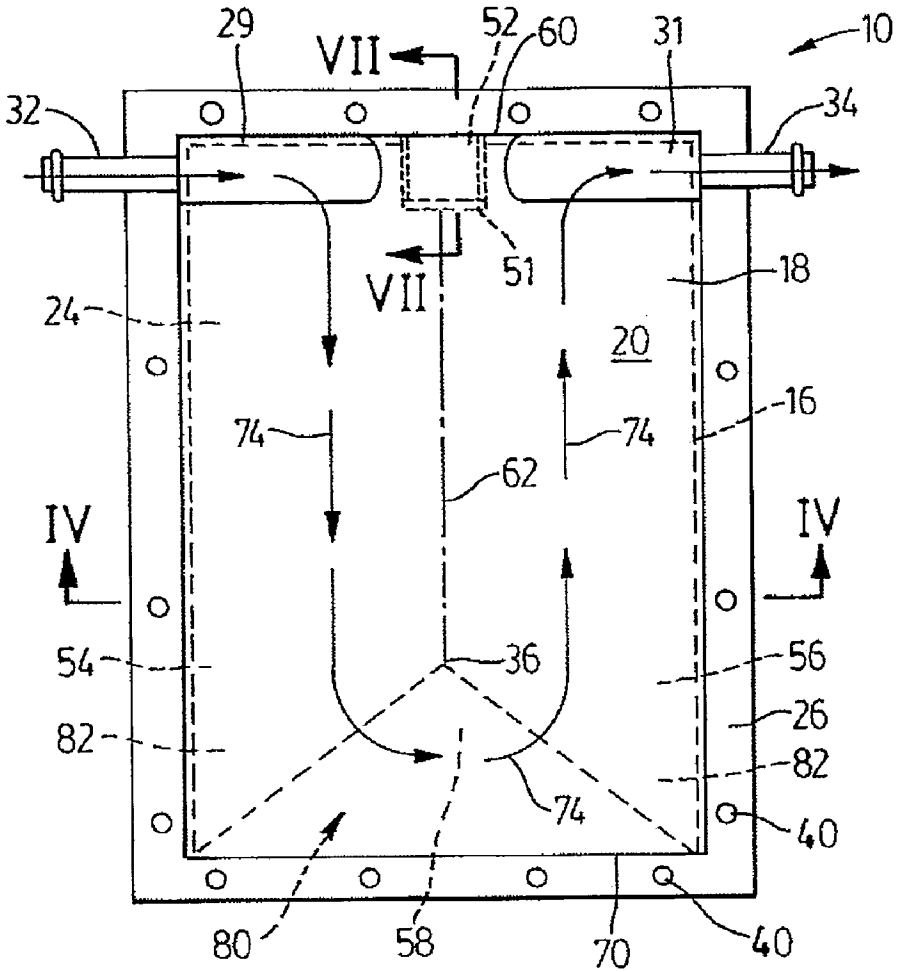
FIG. 2 is a plan view of the heat exchanger of FIG. 1.
Figure 4:
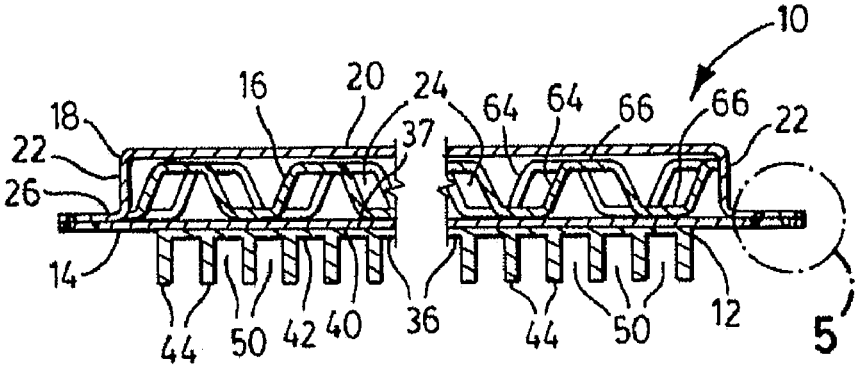
FIG. 4 is a sectional view taken along the lines IV—IV of FIG. 2.

Referring to FIGS. 1, 2 and 4, the cover plate 18 together with the base plate 14 define a flattened, low profile container having an internal fluid-conducting chamber 24. The cover plate 18 includes a central planar portion 20 that is generally rectangular in the illustrated embodiment. A sidewall flange 22 is provided around all four peripheral edges of the central planar portion 20. The sidewall flange 22 extends towards the base plate 14 providing a continuous sidewall about the fluid-conducting chamber 24 that is defined between the cover plate 18 and the base plate 14. An outwardly extending connecting flange 26 is provided along the base edge of the sidewall flange 22. The connecting flange 26 abuts against and is secured to a peripheral edge portion 27 of the base plate 14. In an example embodiment the cover plate 18 is of unitary construction and made of roll formed or stamped aluminum alloy that is braze clad.

A pair of fluid flow openings 28 and 30, one of which functions as a fluid inlet and the other of which is a fluid outlet, are provided near one end 60 of the heat exchanger 10 through the cover plate 18 in communication with the fluid-conducting chamber 24. In one example embodiment, the fluid flow openings 28 and 30 are located in raised inlet and outlet manifolds 29 and 31. Inlet and outlet fittings 32, 34 (see FIG. 2) having flow passages therethrough are, in an example embodiment, provided for openings 28, 30.

The base plate 14, in an example embodiment, is a flat plate having a first planar side that faces an inner side of the central planar portion 20 of the cover plate 18, and an opposite planar side that faces and is connected to the fin plate 12. The base plate 14 is substantially rectangular in the illustrated embodiment, having a footprint that is approximately the same as the footprint of the cover plate 18. Base plate 14 is, in a preferred embodiment, made from a braze clad aluminum or aluminum alloy sheet.

The fin plate 12 may take a number of different forms. In one example embodiment, the fin plate 12 is a unitary structure formed from extruded aluminum or aluminum alloy. The fin plate 12 includes a flat support wall 38 having a first planar side 40 facing and secured to the base plate 14, and an opposite facing side 42 on which is provided a plurality of elongate, parallel fins 44 that each run substantially from a first end to a second end of the support wall 38, and define a plurality of elongate passages 50 therebetween. The side of the fin plate 12 facing away from the base plate 14 is open such that alternating fins 44 and passages 50 are exposed so that, in use, air can flow through the passages 50 and over fins 44. In some applications, other substances such as water, snow and/or ice may be thrown against the exposed fins and passages. In some embodiments, fins 44 may be formed directly on an outer surface of the base plate 14—for example, the base plate 14 could be extruded with fins 44.

Figure 3:
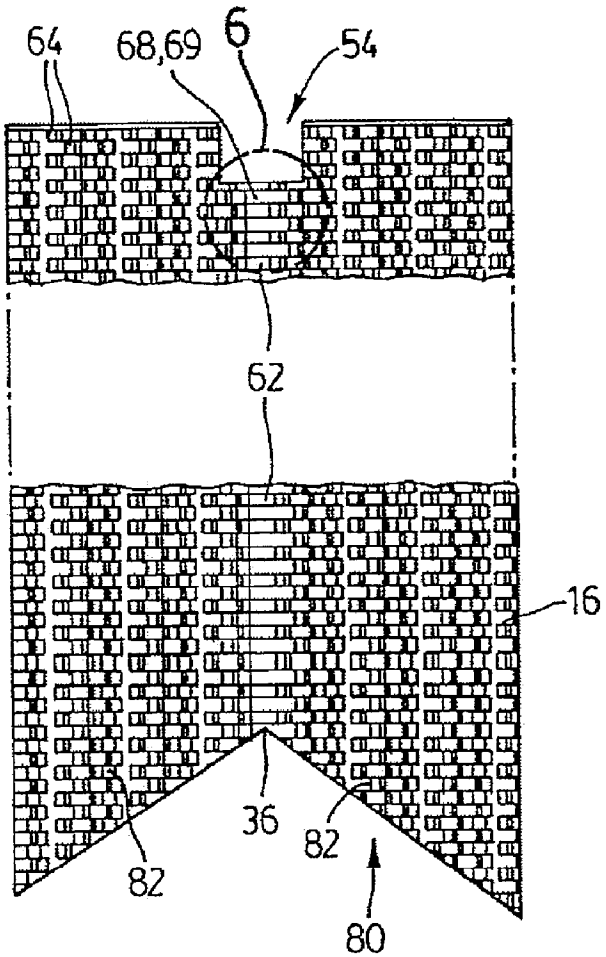
FIG. 3 is a plan view of a turbulizer plate of the heat exchanger of FIG. 1.
Figure 6:
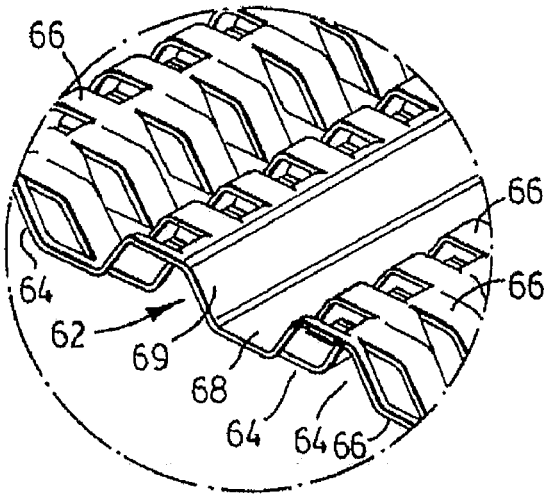
FIG. 6 is an enlarged perspective scrap view of the portion of FIG. 3 indicated by circle 6 in FIG. 3.

The turbulizer plate 16 is located in the fluid-conducting chamber 24 to augment fluid flow therein and thereby increase the efficiency of heat removal from the fluid. The turbulizer plate 16 also adds structural strength to the heat exchanger 10. With reference to FIGS. 3, 4, and 6, in example embodiments, the turbulizer plate 16 is formed of metal, namely aluminum, either by roll forming or a stamping operation. Staggered or offset transverse rows of convolutions 64 are provided on turbulizer plate 16. The convolutions have flat bases and tops 66 to provide good bonds with cover plate 18 and base plate 14, although they could have round tops, or be in a sine wave configuration, if desired. Part of one of the transverse rows of convolutions 64 is compressed or roll formed or crimped together to form transverse crimped portions 68 and 69 (crimped, as used herein, is intended to include crimping, stamping, roll forming or any other method of closing up the convolutions in the turbulizer plate 16). Crimped portions 68, 69 form a barrier 62 to reduce short-circuit flow inside the fluid-conducting chamber 24. The barrier 62 is represented by a line in FIG. 2, and runs from near the first end 60 of heat exchanger at which the fluid inlet and outlet manifolds 29, 31 are located to a termination point 36 that is spaced apart from the opposite second end 70 of the heat exchanger. The barrier 62 splits the flow chamber 24 into two adjacent or parallel flow regions 54, 56 that are connected by a transverse flow region 58 such that a substantial portion of the fluid flowing into the chamber 24 from opening 28 must flow through the turbulizer plate 16 in a U-shaped flow path around point 36, as indicated by arrows 74, prior to exiting the chamber 24 through opening 30 (in the case where opening 28 is the inlet and opening 30 is the outlet for chamber 24).

As best seen in FIGS. 2 and 3, the turbulizer plate 16 is dimensioned to substantially fill the entire fluid flow chamber 24 that is formed between the cover plate 18 and base plate 14, with the exception of a V-shaped notch 80 in the flow region 58 near the second end 70 of the heat exchanger. The notch 80 has its apex at or near the barrier termination point 36, and gets larger towards the second end 70. Such a configuration provides a V-shaped turbulizer free area near the second end 70 of the heat exchanger. The open area provided by notch 80 decreases flow restriction in the flow chamber 24 in the flow region 58 where fluid flows in a U-turn around the termination point 36 of barrier 62. The notch 80 is defined between two generally triangular portions 82 of the turbulizer plate 16 that extend from the barrier termination point 36 to the second end 70. The triangular portions 82 provide structural rigidity to the second end 70 area of the heat exchanger 10 as it limits the unsupported area near the end of the flow chamber 24. It will thus be appreciated that the provision of a V-shaped notch in the turbulizer plate 16 provides a configuration in which flow restriction (and thus pressure drop) around a fluid turning end of the flow chamber 24 can be controlled while at the same time maintaining the structural strength of the heat exchanger 10.

Figure 9:
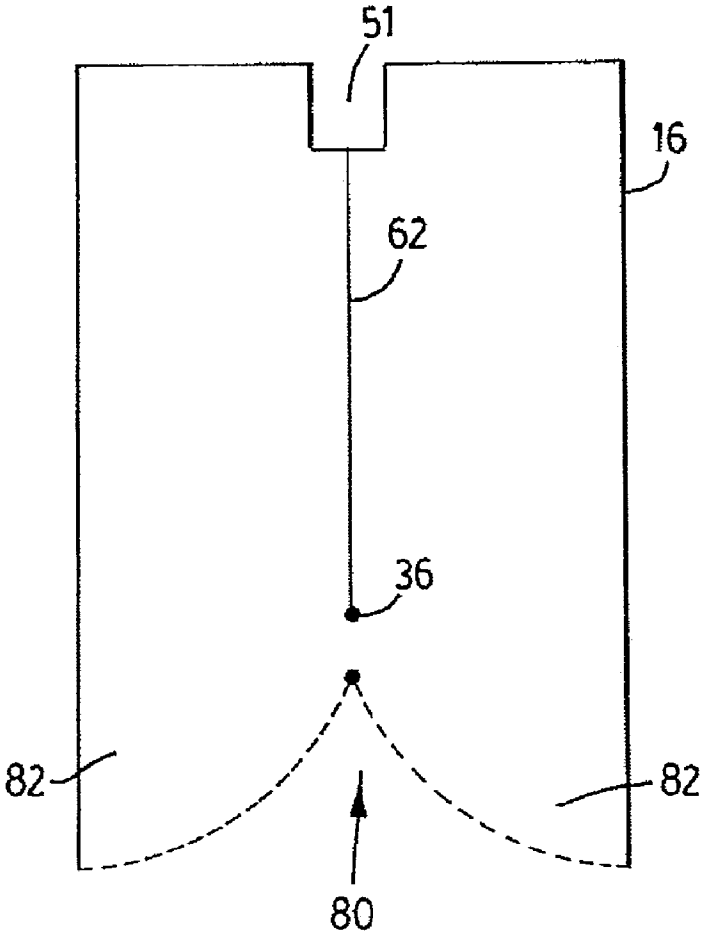
FIG. 9 is a diagrammatic plan view of a further alternative turbulizer plate configuration for the heat exchanger of FIG. 1.
Figure 8:
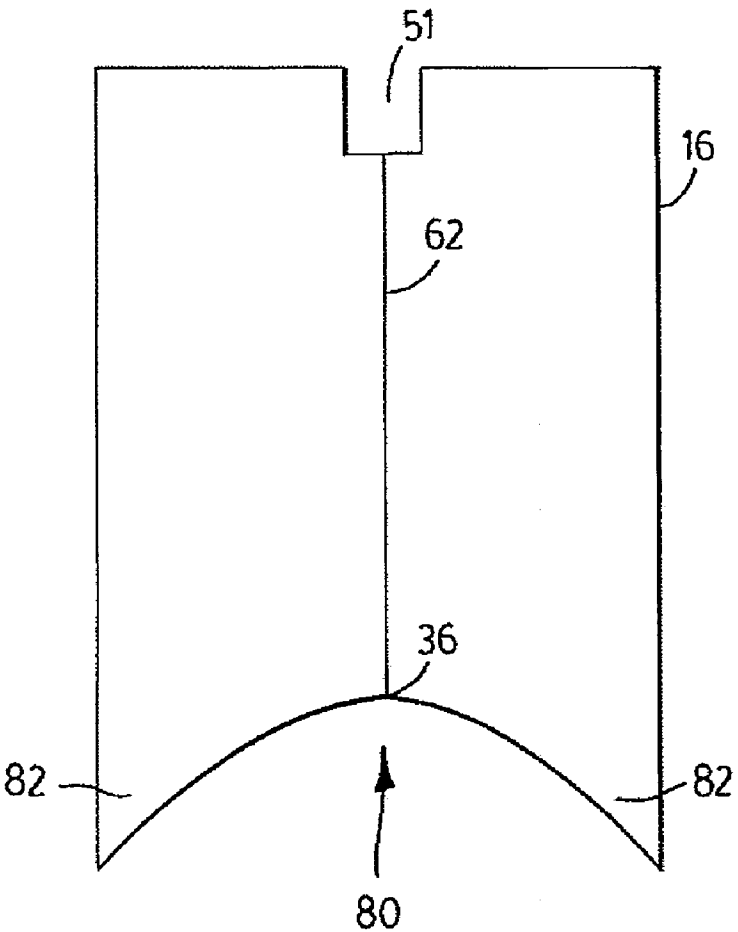
FIG. 8 is a diagrammatic plan view of an alternative turbulizer plate configuration for the heat exchanger of FIG. 1.

In various example embodiments, the notch 80 has a shape other than straight-sided-V. For example, FIGS. 8 and 9 show diagrammatic plan view representations of turbulizer plates 16 having alternative configurations. In FIG. 8, the notch 80 has a semi-circular (or curved "V") shape and is defined between two concave portions of the turbulizer plate 16. In FIG. 9, the notch 80 also has a curved V shape as defined between two convex portions of the turbulizer plate 16. In the various example embodiments, the turbulizer plate 16 includes support portions 82 that define the notch 80 and which have a decreasing size closer to the second end 70 of the flow chamber such that the volume of notch 80 increases from the barrier termination point 36 to the second end 70. The size and configuration of the notch 80 is, in example embodiments, selected to achieve an optimal combination of structural support, pressure drop control, and heat transfer surface area for the specific heat exchanger configuration and application. As indicated in FIG. 9, in some example embodiments the apex of notch 80 and the barrier termination location 36 are not at identical locations—for example, the notch apex could occur closer to the second end 70 of the fluid chamber than the barrier termination location 36. In some embodiments, a few dimples (not shown) may be formed on the cover plate 18 and/or base plate 14 for providing structural support between the two plates in the notch area.

Figure 7:
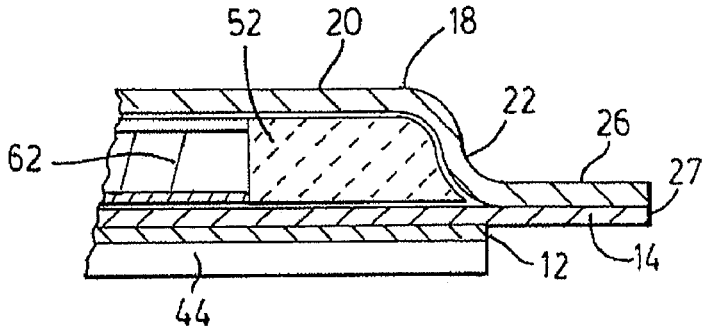
FIG. 7 is a partial sectional view taken along the lines VII—VII of FIG. 2.

In some example embodiments, the barrier 62 extends substantially to the first end 60 of the fluid chamber 24. However, in the example embodiment illustrated in the Figures, as best seen in FIGS. 2 and 3, a small notch 51 is provided at the turbulizer plate end that is located at the first end 60 of the fluid chamber 24. The turbulizer integral barrier 62 terminates at the notch 51. As best seen in FIGS. 2 and 7, a further barrier or baffle block 52 is located in the area provided by notch 51 in order to completely separate the inlet and outlet sides of the fluid chamber 24 at the inlet/outlet end 60 thereof. As noted above, the cover plate 18 includes a sidewall flange 22 that connects a central planar portion 20 to a lateral connecting flange 26. As best seen in FIG. 7, the internal transition areas between the central planar portion 20 to the sidewall flange 22, and from sidewall flange 22 to base plate 14, will generally be curved as it is quite difficult to form such corners to have exact 90 degree angles, especially when using roll formed or stamped metal. The baffle block 52 is dimensioned to fill the notch 51 and contour to the central portion 20, side wall 22 and base plate 14 and the transition areas therebetween to seal the small curved areas at the transition areas that may otherwise be difficult to block with the barrier 62 alone and which could otherwise provide short circuit flow paths between the inlet and outlet openings of the heat exchanger 10. Baffle block 52 is in an example embodiment formed from aluminum or aluminum alloy that is stamped into the appropriate shape, however other materials and forming methods could be used to produce the baffle block 52.

In an example embodiment, the cover plate 18 and the base plate 14 and the baffle block 52 are formed from braze clad aluminum, and the heat exchanger 10 is constructed by assembling the parts in the order shown in FIG. 1, clamping the parts together and applying heat to the assembled components in a brazing oven, thereby sealably brazing the cover plate side connecting flange 26 to the base plate 14 with the turbulizer plate 16 and baffle block 52 sandwiched between the cover plate 18 and base plate 14, and brazing the base plate 14 to the support wall 38 of the fin plate 12. Soldering, welding or adhesives could, in some applications, be used in place of brazing for connecting the components together.

Figure 10:
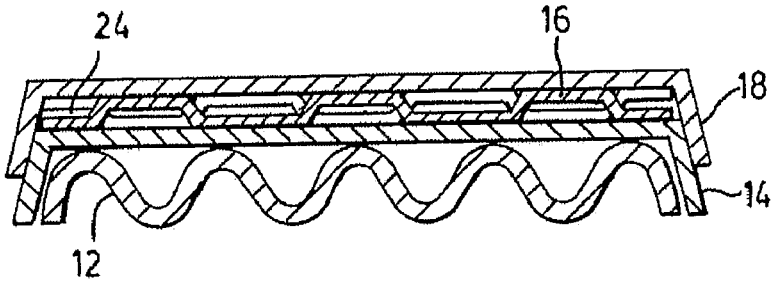
FIGS. 10, 11 and 12 are each sectional views, similar to FIG. 4, showing alternative configurations for cover and base plates of a heat exchanger according to embodiments of the invention.
Figure 11:
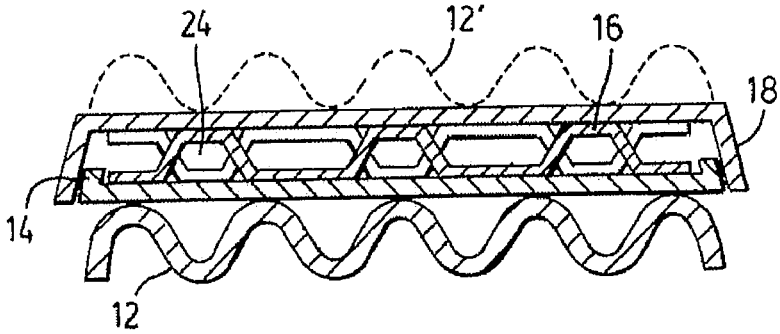
Figure 12:
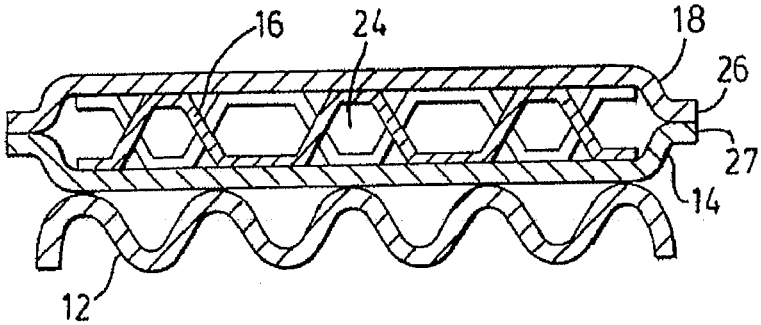

The cover and base plates 18, 14, as well as fin plate 12, could have configurations other than as described above. By way of example, FIGS. 10, 11 and 12 are sectional views showing different configurations of cover and base plates 18, 14 according to other example embodiments of the invention. In each of FIGS. 10, 11 and 12, the cover and base plates 18, 14 define between them closed fluid chamber 24 in which turbulizer plate 16 having a central notch 80 (not shown in FIGS. 10, 11 and 12) is located. In the embodiment of FIG. 10, the cover plate 18 is dish shaped, having a central planar portion with an integral, peripheral, downwardly extending flange that defines an angle of slightly greater than 90 degrees with respect to an inner surface of central planar portion. The base plate 14 is substantially identical, except that it does not have inlet openings formed therethrough, and the downwardly extending flange of the base plate 14 is nested within the flange of the cover plate 18. The fin plate 12 (which is a plate with sinusoidal corrugations in FIG. 10) is secured to a lower surface of the base plate 14.

FIG. 11 shows a similar configuration, except that the base plate 14 has an upwardly turned peripheral flange that extends in the opposite direction of the cover plate flange, and which has an outer surface that is nested within and brazed to an inner surface of cover plate flange. The configurations shown in FIGS. 10 and 11 could be easily "flipped over" with the fin plate being placed on the opposite side, as shown by phantom line 12' in FIG. 11. Furthermore, in some embodiments, fin plates may be used on both sides of the heat exchanger.

FIG. 12 shows a further configuration in which the cover plate 18 and base plate 14 are identical (except that there are no flow openings in the base plate), each having an abutting flange 26, 27 formed about a central planar portion thereof.

Figure 5:
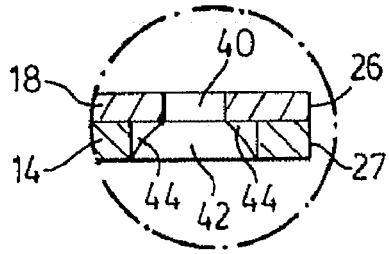
FIG. 5 is an enlarged scrap view of the portion of FIG. 4 indicated by circle 5 in FIG. 4.
Figure 13:
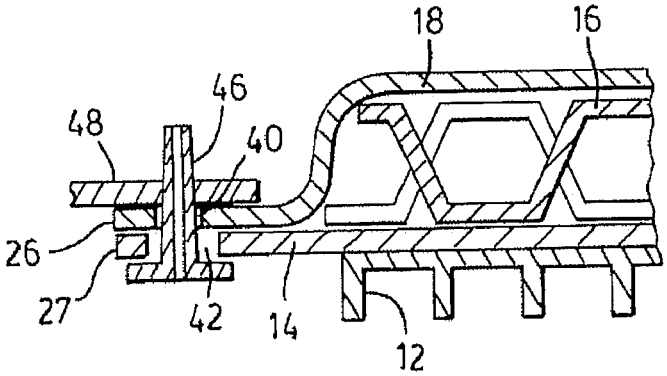
FIG. 13 is a partial sectional view showing a rivet passing through aligned mounting holes of a heat exchanger according to embodiments of the invention.
Figure 14A:
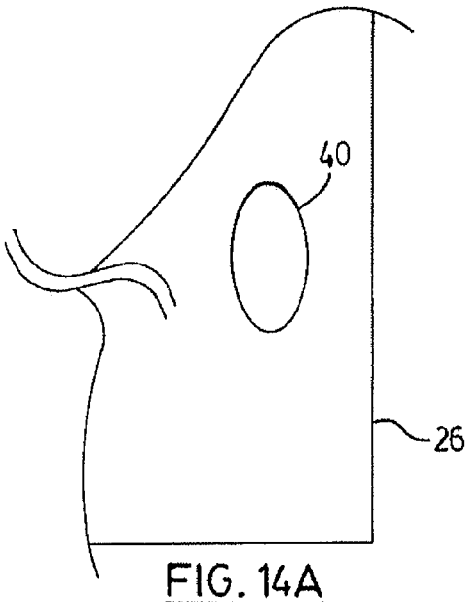
FIGS. 14A–14D show partial plan views of a heat exchanger illustrating alternative mounting hole configurations.
Figure 14B:
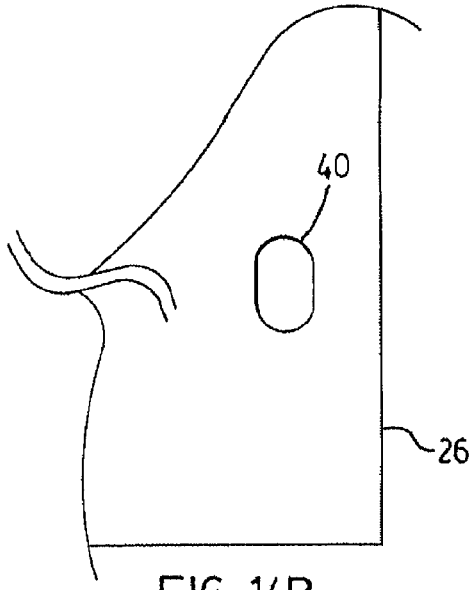
Figure 14C:
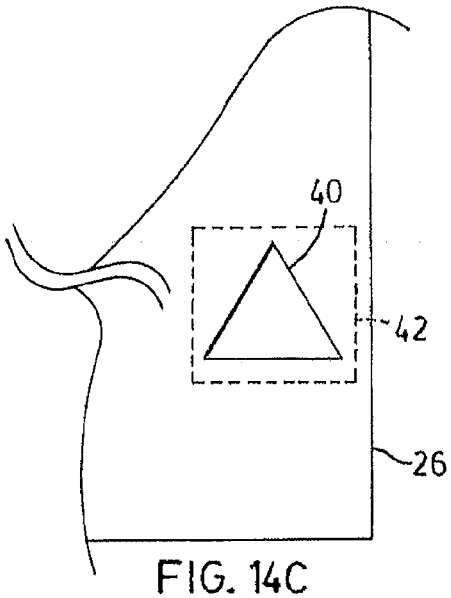
Figure 14D:
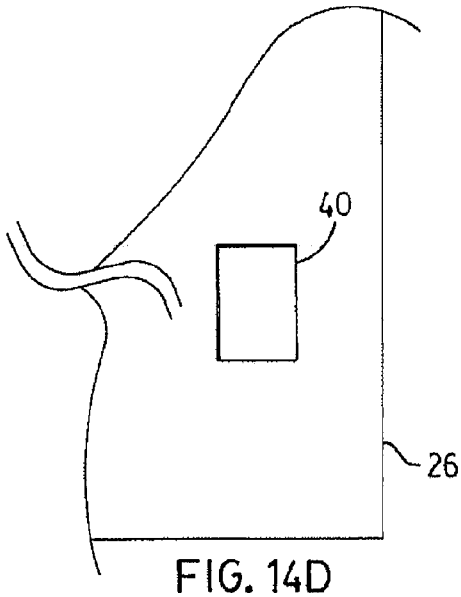

Referring again to the embodiment of FIG. 1, as described above, the cover plate 18 of such embodiment includes a connecting flange 26 that abuts against and is secured to an edge portion 27 of the base plate 14. The connecting flange 26 and edge portion 27 collectively provide a mounting flange for mounting the heat exchanger to the chassis of a vehicle, and in an example embodiment, a series of annular openings or holes 40 and 42 are provided through the connecting flange 26 and edge portion 27, respectively. The openings 40 and 42 may be punched or otherwise formed through the connecting flange 26, and edge portion 27, respectively. When the heat exchanger 10 is assembled, each opening 40 through the connecting flange 26 is aligned with a corresponding opening 42 through the edge portion 27, as best seen in FIG. 5. Each pair of aligned openings 40, 42 provides an opening through the mounting flange of the heat exchanger 10 suitable for receiving a mounting fastener such as a rivet or bolt so that the heat exchanger can be secured to a vehicle chassis. For example, FIG. 13 is a partial sectional view showing a not yet compressed rivet 46 passing through an aligned pair of cover and base plate openings 42, 40 and through a further opening provided in a vehicle chassis 48. As seen in FIGS. 5 and 13, the opening 40 through the cover plate connecting flange 26 is smaller than the opening 42 through the base plate edge portion 27. In one example embodiment, both of the openings 40 and 42 are circular, with the opening 40 having a smaller diameter than the opening 42. However, other shaped holes can be used in other example embodiments—for example, as shown in FIGS. 14A–14D one or both of the openings could be oval (FIG. 14A), elliptical (FIG. 14B), triangular (FIG. 14C) or rectangular (FIG. 14D), or square, or star shaped, or other multi-sided shape, among other shapes, so long as one of the openings 40, 42 in each aligned pair is larger than the other. When aligned, the openings of a pair may not be in exact concentric alignment, however in an example embodiment, the perimeter or circumference of the smaller opening does not overlap the perimeter of the larger opening. Thus, the effective diameter or size of the resulting opening formed by the aligned pair of openings is substantially equal to that of the smaller opening 40. In some embodiments, the cover plate openings 40 may be larger rather than smaller than the base plate openings 42 for all or some of the aligned pairs. In some embodiments, the smaller and larger openings in a pair could have different shapes, for example a smaller circular opening used in combination with a larger elliptical opening, or, as shown in FIG. 14C, a triangle shaped opening 40 used in combination with a square shaped opening 42. In some example embodiments where circular openings are used for receiving a mounting rivet or bolt, the smaller opening has a diameter of between 5 and 6 mm and the larger opening has a diameter that is between 7 and 8 mm, although it will be understood that such dimensions and percentages are provided as non-limiting examples only as opening size will be affected by, among other things, plate thickness and the desired use of the aligned openings. In one example embodiment the difference in opening sizes is selected so that if the smaller opening and large opening are in concentric alignment, the minimum distance between the edge of the larger opening and the edge of the smaller opening will be at least equal to the thickness of the plate with the larger opening.

The use of different sized aligned openings 40, 42 provides an improved degree of manufacturing tolerance than would be provided by openings having a common size, especially when braze-clad (or braze-filler metal coated) plates 14 and 18 are used to make the heat exchanger 10. For example, even if the openings 40, 42 of a pair are slightly misaligned, as long as the misalignment does not exceed the amount by which the larger hole exceeds the size of the smaller hole, the resulting mounting hole formed by the aligned pair will still have the same effective diameter (ie. that of the smaller opening). Additionally, as shown in FIG. 5, the brazing process often results in the formation of fillets 44 of cladding material. In aligned holes of the same size, the fillet material can partially block the resulting mounting hole. However, as can be seen in FIG. 5, when openings of different sizes are used, the larger circumference of the larger opening 42 draws the fillet or clad material back from the area of the smaller opening 40 such that the fillet 44 does not obstruct the smaller opening 40. Thus, the use of aligned openings of different sizes allows the final mounting hole size to be controlled with a greater degree of predictability and with looser manufacturing tolerance than would be required if openings of the same size through adjacent plates were aligned together. Thus, the use of different sized openings addresses the problem of trying to fit a pin-like device through a hole, where the hole is made from a lap joint of 2 or more layers, and where the pin has a close outer diameter to that of the nominal hole inside diameter. During brazing of a conventional lap joint containing identical holes, the hole edges provide a capillary drawing force on the molten filer metal, tending to draw the filler metal into the hole. Not only does the filer metal partially block the hole, but its location within the hole is unpredictable, and thus difficult to compensate for by conventional means. Also, when the holes are identical in size and they are slightly misaligned, this actually compounds the problem by increasing the capillary effects involved. The use of different sized holes in a lap joint helps to alleviate such problems.

Although the use of two different sized aligned holes has been described above in a specific heat exchanger configuration, different sized aligned openings can be used in any application in which two different plates or sheets having respective openings therethrough are brazed together with the openings in alignment. Although the aligned openings have been described above as mounting openings, the openings could be provided for other reasons, such as for allowing a protrusion or wire to pass through the aligned openings of plates 14, 18, or to accept a bolt or other fastener for connecting the plates 14, 18 to another device in other than a mounting capacity. The openings could be also provided through metal plate portions used as heat exchanger mounting brackets.

The heat exchanger 10 can conveniently be used as a low-profile device for cooling a fluid that passes through the fluid flow container defined by the cover plate 18 and base plate 14, with heat from fluid being conducted away from the fluid to exposed fins 44, which in turn are cooled by air passing there through. In some applications, the cooling of exposed fins 44 is assisted by other substances such as snow and water that gets thrown against the exposed fins 44. The heat exchanger 10 can be used, for example, as an engine coolant cooler in a snowmobile, or as an underbody mounted fuel cooler in an automotive application, although these examples are not exhaustive.

Figure 16:
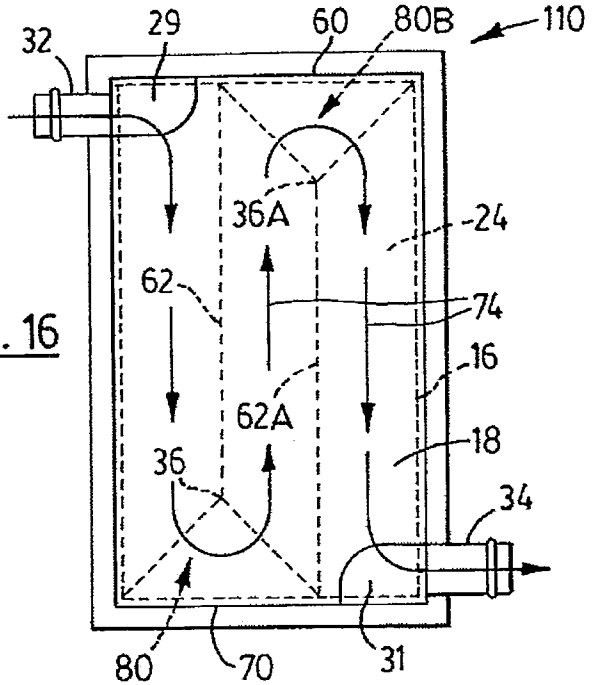
FIG. 16 is a plan view of a heat exchanger according to a further example embodiment.
Figure 15:
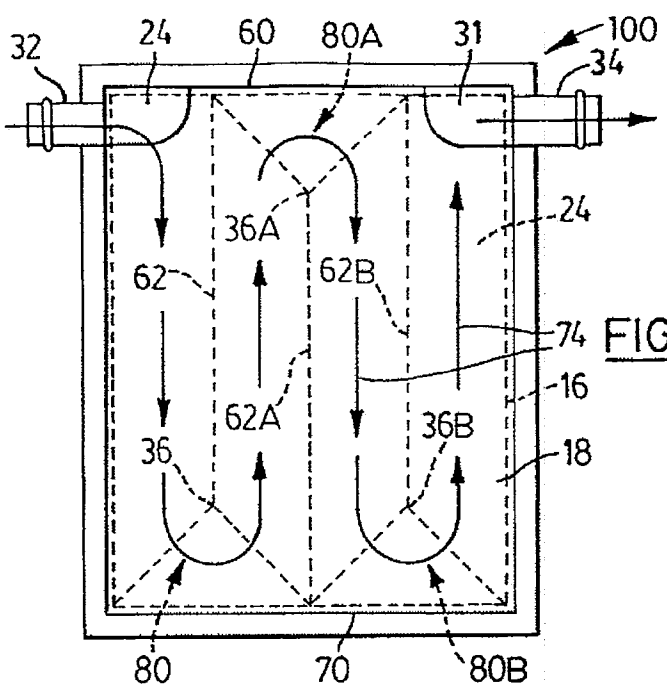
FIG. 15 is a plan view of a heat exchanger according to another example embodiment.

Although the heat exchanger 10 described above is a two-pass heat exchanger, aspects of the present invention could also be applied to heat exchangers having more than two-passes. By way of example, FIG. 15 shows a plan view of a four-pass heat exchanger, indicated generally by reference 100, and FIG. 16 shows a plan view of a three-pass heat exchanger, indicated generally by reference 110, according to further example embodiments of the invention. Heat exchangers 100 and 110 are similar in construction and function to heat exchanger 10 with the exception of differences that will be apparent from the Figures and the present description. In both FIGS. 15 and 16, the turbulizer plate 16 is indicated in dashed lines.

With reference to the four-pass heat exchanger 100 of FIG. 15, the turbulizer plate 16 includes three internal barriers 62, 62A and 62B formed by crimped lines of convolutions in the turbulizer plate. Barriers 62 and 62B each extend from substantially the first end 60 of the fluid chamber 24 to termination locations 36 and 36B, respectively, which are spaced apart from the second end 70. Barrier 62A extends from substantially the second end 70 of the fluid chamber 24 to a termination location 36A spaced apart from the first end 60. The three barriers 62, 62A and 62B divide the heat exchanger fluid chamber 24 into four side-by-side connected flow regions through which fluid flows back and forth in a serpentine manner in the direction indicated by arrows 74. In order to reduce flow restriction at the regions in the flow chamber 24 at which fluid must pass around a bend, V-shaped notches 80, 80A and 80B are provided in the end areas of turbulizer plate 16 at the regions where the fluid is forced to turn around the barriers 62, 62A and 62B, respectively.

With reference to the three-pass heat exchanger 110 of FIG. 16, the turbulizer plate 16 includes two internal barriers 62 and 62A formed by crimped lines of convolutions in the turbulizer plate. Barrier 62 extends from substantially the first end 60 of the fluid chamber 24 to termination locations 36 which is spaced apart from the second end 70. Barrier 62A extends from substantially the second end 70 of the fluid chamber 24 to a termination location 36A spaced apart from the first end 60. The two barriers 62 and 62A divide the heat exchanger fluid chamber 24 into three side-by-side connected flow regions through which fluid flows back and forth in the direction indicated by arrows 74. In order to reduce flow restriction at the regions in the flow chamber 24 at which fluid must pass around a bend, V-shaped notches 80 and 80A are provided in the end areas of turbulizer plate 16 at the regions where the fluid is forced to turn around the barriers 62 and 62A, respectively. Although not shown in FIGS. 15 and 16, barrier or baffle blocks 52 could be used at the sealing ends of each of the baffles 62, 62A and 62B to reduce the chance of short circuiting at such ends.

Figure 17:
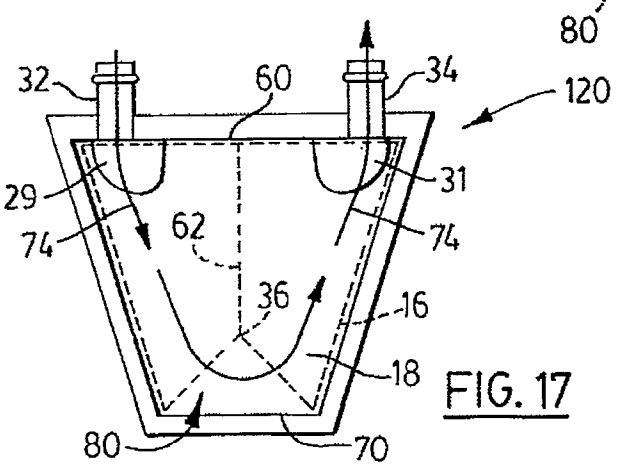
FIG. 17 is a plan view of a heat exchanger according to yet another example embodiment.

FIG. 17 shows yet a further heat exchanger, indicated generally by reference 120, according to other embodiments of the invention. Heat exchanger 120 is a two-pass substantially identical to heat exchanger 10, except that the heat exchanger 120 has a trapezoidal rather than rectangular configuration.

Many components of the heat exchanger of the present invention have been described as being made from aluminum or aluminum alloy, however it will be appreciated that other metals could suitably be used to form the components, and in some applications non-metallic materials might be used, including for example thermally bondable, ultrasonically bondable, and adhesive bondable polymers. As will be apparent to those skilled in the art, many alterations and modifications are possible in the practice of this invention without departing from the spirit or scope thereof. Accordingly, the scope of the invention is to be construed in accordance with the substance defined by the following claims.

What is claimed is:

1. A heat exchanger comprising:

a first plate;

a second plate joined about a periphery thereof to the first plate, the first plate and second plate having substantially planar, spaced apart central portions defining a fluid flow chamber therebetween having an inlet opening, an outlet opening and spaced apart first and second ends;

a flow circuiting barrier in the flow chamber extending from substantially the first end of the fluid flow chamber to a barrier termination location that is spaced apart from the second end of the fluid flow chamber, the barrier dividing the fluid chamber into first and second flow regions in flow communication with each other between the barrier termination location and the second end of the fluid flow chamber;

a turbulizer having rows of fluid flow augmenting convolutions, the turbulizer located in the first and second flow regions and including portions defining a notch area therebetween, at least part of the notch area being between the barrier termination location and the second end, said notch area providing a turbulizer free area in the fluid chamber between the barrier termination location and the second end.

2. The heat exchanger of claim 1 wherein the notch area decreases inward from the second end of the fluid chamber and extends no closer to the first end than the barrier termination location.

3. The heat exchanger of claim 2 wherein the notch area is substantially V-shaped.

4. The heat exchanger of claim 3 wherein the V-shaped notch area has its apex adjacent the barrier termination location.

5. The heat exchanger of claim 1 wherein at least a portion of the barrier is integrally formed into the turbulizer and the turbulizer together with the notch area is substantially the same size as the fluid chamber.

6. The heat exchanger of claim 5 wherein the turbulizer is formed from metal and brazed to the central portions of the first and second plates, the barrier portion formed in the turbulizer being a crimped area along which the metal turbulizer is closed.

7. The heat exchanger of claim 5 wherein the fluid chamber is substantially rectangular in shape.

8. A heat exchanger comprising:

a first plate;

a second plate joined about a periphery thereof to the first plate, the first plate and second plate having substantially planar, spaced apart central portions defining a fluid flow chamber therebetween having an inlet opening, an outlet opening and spaced apart first and second ends, the inlet and outlet openings being located near the first end of the fluid chamber;

flow circuiting barrier in the flow chamber extending from substantially the first end of the fluid flow chamber to a barrier termination location that is spaced apart from the second end of the fluid flow chamber, the barrier dividing the fluid chamber into first and second flow regions in flow communication with each other between the barrier termination location and the second end of the fluid flow chamber;

a turbulizer having rows of fluid flow augmenting convolutions, the turbulizer located in the first and second flow regions and including portions defining a notch area therebetween, at least part of the notch area being between the barrier termination location and the second end, wherein the barrier includes a portion integrated into the turbulizer and a separately formed barrier block, the barrier block being located between the first and second flow regions and having one end tightly conforming to the first end of the flow chamber and another end abutting against the barrier portion integrated into the turbulizer.

9. The heat exchanger of claim 8 wherein the barrier block is received in a barrier block notch located in the turbulizer at the first end of the flow chamber.

10. The heat exchanger of claim 8 wherein the barrier block is formed of metal and secured to the first and second plates by brazing.

11. A heat exchanger comprising:

a first plate;

a second plate joined about a periphery thereof to the first plate, the first plate and second place having substantially planar, spaced apart central portions defining a fluid flow chamber therebetween having an inlet opening, an outlet opening and spaced apart first and second ends, the first plate and second plate having abutting peripheral edge portions joined together to form a flange including a plurality of pairs of aligned openings through the first and second plates, each pair of openings including an opening of one size through one of the first or second plates aligned with an opening of a different size through the other of the first or second plates;

a flow circuiting barrier in the flow chamber extending from substantially the first end of the fluid flow chamber to a barrier termination location that is spaced apart from the second end of the fluid flow chamber, the barrier dividing the fluid chamber into first and second flow regions in flow communication with each other between the barrier termination location and the second end of the fluid flow chamber;

a turbulizer having rows of fluid flow augmenting convolutions, the turbulizer located in the first and second flow regions and including portions defining a notch area therebetween, at least part of the notch area being between the barrier termination location and the second end.

12. The heat exchanger of claim 11 wherein the at least one of the first and second plates is formed from braze-clad metal.

13. The heat exchanger of claim 1 including a plurality of air-side tins on the planar portion of at least one of the first and second plates.

14. The heat exchanger of claim 1 wherein the first plate is a planar sheet and the second plate has an integral sidewall flange provided about a peripheral edge thereof, the sidewall flange extending towards and sealably connected to the first plate.

15. The heat exchanger of claim 1 including a second flow circuiting barrier in the flow chamber extending from substantially the second end of the fluid flow chamber to a second barrier termination location that is spaced apart from the first end of the fluid flow chamber, the second barrier providing a third flow region in the fluid chamber that is in flow communication with the second flow region between the second barrier termination location and the first end of the fluid flow chamber, the first and second barriers circuiting fluid through the fluid chamber in a serpentine path;

the turbulizer also being located in the third flow region and including further portions defining a further notch area therebetween, at least part of the further notch area being between the second barrier termination location and the first end.

16. The heat exchanger of claim 15 including a third flow circuiting barrier in the flow chamber extending from substantially the first end of the fluid flow chamber to a third barrier termination location that is spaced apart from the second end of the fluid flow chamber, the third barrier providing a fourth flow region in the fluid chamber that is in flow communication with the third flow region between the third barrier termination location and the second end of the fluid flow chamber, the first and second and third barriers circuiting fluid through the fluid chamber in a serpentine path;

the turbulizer also being located in the fourth flow region and including other portions defining a third notch area therebetween, at least part of the third notch area being between the third barrier termination location and the second end.

17. A heat exchanger comprising:

a first plate;

a second plate joined about a periphery thereof to the first plate, the first plate and second plate having substantially planar spaced apart central portions defining a fluid flow chamber therebetween having a first end and a second end and an inlet opening and an outlet opening; and a turbulizer plate located in the flow chamber and having rows of fluid flow augmenting convolutions, the turbulizer plate extending from substantially the first end to the second end of the flow chamber and having a plurality of the convolutions crimped for forming a flow circuiting barrier extending from the first end to a barrier end spaced apart from the second end for dividing the flow chamber into adjacent flow regions that are in flow communication between the barrier end and the second end, the turbulizer plate defining a notch area than decreases in area inward from the second end for providing a turbulizer plate free area in the fluid chamber between the barrier end and the second end.

18. The heat exchanger of claim 17 wherein the notch area is substantially V-shaped, having its apex between the barrier termination location and the second end.

19. A multi-pass heat exchanger including:

first and second plates forming a fluid chamber therebetween having an inlet opening and an outlet opening;

a turbulizer plate having rows of fluid flow augmenting convolutions in the fluid chamber, the turbulizer plate including at least one barrier dividing the fluid chamber into first and second pass regions such that fluid flowing in the fluid chamber flows around an end of the barrier when flowing from the first pass region to the second pass regions, the turbulizer plate having portions defining a notch area therebetween for fluid to pass through when flowing in the fluid chamber around the end of the barrier from the first pass region to the second pass region, the notch area providing a turbulizer free area in the fluid chamber between said end of the barrier and an end of the fluid chamber.

20. The heat exchanger of claim 19 wherein the first and second pass regions are side-by-side such that fluid flows in a generally U-shaped path around the end of the barrier and the notch area gets larger further from the end of the barrier.

* * * * *

UNITED STATES PATENT AND TRADEMARK OFFICE

CERTIFICATE OF CORRECTION

PATENT NO. : 7,182,125 B2
APPLICATION NO. : 10/724481
DATED : February 27, 2007
INVENTOR(S) : Martin et al.

It is certified that error appears in the above-identified patent and that said Letters Patent is hereby corrected as shown below:

Column 12, line 11, please delete “than” and insert --that--.

Signed and Sealed this

Twenty-eighth Day of August, 2007

JON W. DUDAS
*Director of the United States Patent and Trademark Office*